United States Patent [19]

Miura

[11] 4,344,444

[45] Aug. 17, 1982

[54] CIGARETTE HOLDER WITH NICOTINE EXTRACTOR

[76] Inventor: Noriyoshi Miura, 1-5, Takashimadaira 4-chome, Itabashi-ku, Tokyo, Japan, 175

[21] Appl. No.: 206,361

[22] Filed: Nov. 13, 1980

[30] Foreign Application Priority Data

Nov. 28, 1979 [JP] Japan ..... 54/164399

[51] Int. Cl.[3] ..... A24F 13/06

[52] U.S. Cl. ..... 131/201; 131/210; 131/346

[58] Field of Search ..... 131/201, 210, 187, 200, 131/346

[56] References Cited

U.S. PATENT DOCUMENTS 2,709,441 5/1955 Motsinger ..... 131/227 X
3,174,487 3/1965 Missler ..... 131/210 X
3,367,343 2/1968 White et al. ..... 131/201 X
3,373,750 3/1968 Beam ..... 131/346 X

*Primary Examiner*—Stephen C. Pellegrino
*Attorney, Agent, or Firm*—George B. Oujevolk

[57] ABSTRACT

A cigarette holder having an attractive appearance and a compact structure suitable for use by ladies without any feel of reluctance, and capable of effectively removing nicotine and tar while permitting a visual check of the state of removal of nicotine and tar from the outside. A nicotine extractor made of a colored material, for removing the nicotine and tar by impact caused by collision of smoke, is fitted in a cigarette holder body made of a transparent material. When the colored nicotine extractor has become invisible from the outside of the cigarette holder body due to accumulation of nicotine and tars, the cigarette is no longer usable and can be discarded.

3 Claims, 6 Drawing Figures

CIGARETTE HOLDER WITH NICOTINE EXTRACTOR

BACKGROUND OF THE INVENTION

1. Field of the Invention

The present invention relates to a compact cigarette holder having a superior effect in removing nicotine and tars.

2. Description of the Prior Art

Recently, the habit of smoking has become popular also among ladies, which poses a problem that the mother and the embryo are adversely affected by nicotine and tar contained in the tobacco smoke.

Various cigarette holders capable of removing nicotine and tar have been proposed already. These cigarette holders, however, are generally expensive and large-sized, and have appearance suitable for men, so that ladies are usually somewhat reluctant to use these pipes.

OBJECT OF THE INVENTON

It is, therefore, an object of the invention to provide a small-sized tobacco cigarette holder suitable particularly for use by ladies and disposable after smoking of 4 to 5 cigaretes, having reduced size and simplified structure and capable of effectively removing the nicotine and tar while affording a visual check of removal of nicotine and tar from the outside.

BRIEF SUMMARY OF THE INVENTION

To this end, according to the invention, there is provided a hollow cylindrical body made of a synthetic resin and having a cigarette insertion opening, a mouth portion with, and a flue therebetween; and a colored nicotine extractor having a disc portion, a shaft portion, and a plurality of small apertures; wherein the nicotine extractor is disposed in the flue of the hollow body in such a manner that the outlet side of the small apertures face the inner wall of the flue with a small clearance therebetween. In use, the smoke collides with the inner wall of the flue as it is discharged through the small apertures so that the nicotine and tar are made to attach to the inner surface of the wall of the flue.

The above and other objects, as well as advantageous features of the invention will become clear from the following description of the preferred embodiments taken in conjunction with the accompanying drawings.

BRIEF DESCRIPTION OF THE DRAWINGS

The invention will now be further described, by way of example, with reference to the accompanying drawings in which.

DESCRIPTION OF THE PREFERRED EMBODIMENTS

Preferred embodiments of the invention will be described hereinunder with reference to the accompanying drawings.

Figure 1:
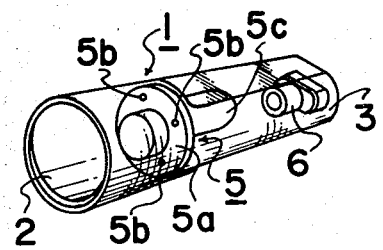
FIG. 1 is a perspective view of a cigarette holder according to an embodiment of the invention.
Figure 2:
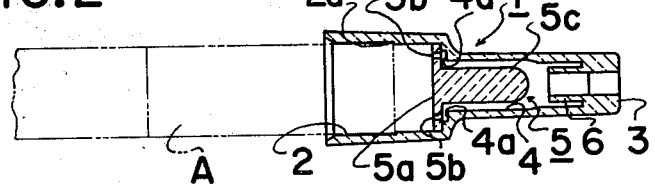
FIG. 2 is a side sectional view of FIG. 1.
Figure 3:
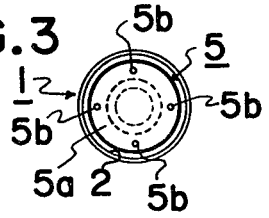
FIG. 3 is a front view of FIG. 1.

Referring first to FIGS. 1 to 3, a reference numeral 1 designates a cigarette holder body made of a transparent synthetic resin and has a length which is as small as about 25 mm. The cigarette holer body 1 is provided at one end with a cigarette insertion opening 2 and a mouth portion 3 at its other end. The cigarette holder body 1 is gradually tapered between both ends thereof and both side portions of the mouth portion are cutaway to provide a substantially rectangular cross-section. The cigarette insertion opening 2 and the mouth portion 3 are in communication with each other through a flue 4 extending in the longitudinal direction along the axis of the body 1 of the cigarette holder.

A reference numeral 5 designates a nicotine extractor having a disc portion **5*a* and a plurality of small apertures 5*b*,5*b*,5*b* formed in the disc portion 5*a*. The nicotine extractor 5 also has a shaft portion 5*c* projecting from the center of the disc portion 5*a***. A colored synthetic resin is used as the material of the nicotine extractor.

The nicotine extractor 5 is placed in the cigarette holder body 1 with its shaft portion **5*c* directed inwardly, through the cigarette insertion opening 2, and is seated on the bottom of the latter with the shaft portion 5*c* projecting into the flue 4 beyond the bottom of the cigarette insertion opening 2. A smoke collision wall 4*a* is formed to protrude from the surface of the flue 4 so as to oppose to outlet side of the small apertures 5*b*,5*b*,5*b*** with a small gap therebetween.

Therefore, the cigarette insertion opening 2 and the mouth portion 3 communicates with each other through the small apertures **5*b*,5*b*,5*b* of the nicotine extractor 5. Furthermore, a smoke tube 6 is formed to project from the portion of the cigarette holder body 1 near the mouth portion 3 toward the inside of the flue 4**.

In use, a cigarette A is inserted to such a depth that the inner end of the cigarette contacts a step **2*a* formed in the insertion opening 2. As the user smokes, the smoke is induced through the small apertures 5*b*,5*b*,5*b* to collide with the smoke collision wall 4 and flows toward the mouth 3 through the gap between the inner surface of the flue 4 and the shaft portion 5*c***.

As a result of collision of the smoke with the smoke collision wall **4*a*, the nicotine contained by the smoke is extracted and attaches to the surface of the smoke collision wall 4*a***.

After the use of the cigarette holder for five or more cigarettes, the nicotine attaches to and accumulated on not only the smoke collision wall **4*a* but also to the inner surface of the flue 4 leading from the latter, so that the shaft portion 5*c* of the nicotine extractor 5 becomes invisible or hardly visible from the outside of the cigarette holder body 1. If the pipe in this state is used further, the nicotine accumulated on the bottom of the flue 4 spills and flows toward the mouth portion 3**.

Therefore, the cigarette holder is discarded as being unusable just before the nicotine and tars start to flow toward the mouth portion, i.e. at the moment at which the shaft portion **5*a* becomes invisible from the outside. Test results show that the shaft portion 5*a*** becomes invisible after smoking of 5 to 6 cigarettes.

Figure 4:
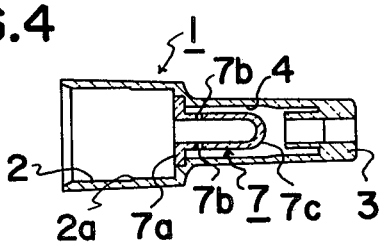
FIG. 4 is a side sectional view showing another embodiment.
Figure 5:
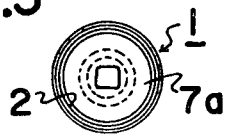
FIG. 5 is a front view of FIG. 4.

FIGS. 4 and 5 show another embodiment of the invention in which a nicotine extractor 7 made of a colored synthetic resin is seated on the bottom of the cigarette insertion opening 2 of the cigarette holder body 1 which is also made of a transparent synthetic resin. The nicotine extractor 7 has a shaft portion *7c* which, in this case, is a hollow member opened at its side adjacent to the disc portion *7a*. The hollow shaft portion *7c* has a plurality of small radial apertures *7b,7b* opening toward the inner surface of the flue 4.

In use, the smoke of the cigarette is induced through these radial apertures *7b,7b* and collides with the inner surface of the flue 4 which opposes to the radial apertures *7b,7b* with a slight gap preserved therebetween, so that the nicotine and tar suspended by the smoke are extracted. The nicotine and tar thus extracted then attach to the inner surface of the flue 4 around the shaft portion *7c*, so that the shaft portion *7c* becomes finally invisible from the outside. It is then judged that the cigarette holder has become unusable and the nicotine and tars flow to reach the mouth portion 3 if the cigarette holder is used further in this state, as in the case of the first embodiment described in connection with FIGS. 1 to 3.

The embodiment shown in FIGS. 4 and 5 offers the advantage that the nicotine and tar removal effect is increased due to an increased length of the flue 4 as compared with the preceding embodiment.

Figure 6:
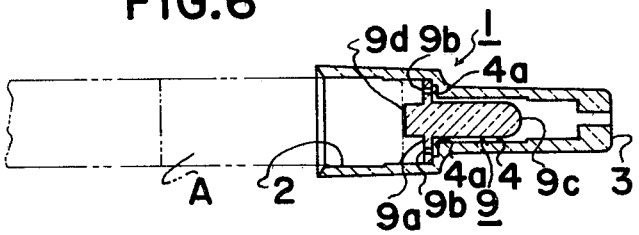
FIG. 6 is a side sectional view showing still another embodiment.

FIG. 6 shows still another embodiment of the invention in which a colored nicotine extractor 9 seated on the bottom of the cigarette insertion opening 2 of the transparent cigarette holder body 1 has a projection *9d* formed on the side of the disc portion *9a* opposite to the shaft portion *9c*, and the smoke tube in the pipe body is eliminated.

In the cigarette holder of this embodiment, the projection *9d* effectively prevents the inner end of the cigarette inserted into the cigarette insertion opening 2 from covering the small apertures *9b,9b* in the nicotine extractor. In addition, the elimination of the smoke tube permits the smoke to flow through the flue 4 at a moderate velocity without staying in the latter, so that the effect of removal of nicotine and tars is further enhanced.

In whichever one of the described embodiments may be adapted the nicotine extractor 5,7,9 preferably is colored so as to be visually checked from the outside through the wall of the cigarette holder body 1. In addition, the length of the cigarette holder as a whole is reduced to about 25 mm to impart a fashionable feel suitable for use by ladies.

It is to be understood that the embodiments shown are merely illustrative and that such changes may be made as come within the scope of the following claims.

What is claimed is:

1. A cigarette holder comprising:

(a) a hollow cylindrical body made of transparent synthetic resin having a cigarette insertion opening at one end with a mouth section at the other end, said body being tapered at least in said mouth section, a central section in said body;

(b) a flue (4) extending in said body from said central section towards said mouth section, said flue having a step section towards said one end;

(c) a nicotine extractor (5) made of a colored synthetic resin in said flue (4) said nicotine extractor having a disc portion disposed to engage said step section and an elongated body portion extending toward said mouth section with a small gap between said body portion and said hollow cylindrical body inner wall, said extractor having a plurality of apertures of small size in at least one of said portions whereby smoke flowing out of said small apertures collides with the inner surface of said flue and the nicotine and tar attach to said flue inner surface.

2. A cigarette holder as claimed in claim 1 wherein said apertures are in said disc portion.

3. A cigarette holder as claimed in claim 1 wherein said apertures are in said body portion.

* * * * *